US006832903B2

(12) United States Patent
Petersen et al.

(10) Patent No.: US 6,832,903 B2
(45) Date of Patent: Dec. 21, 2004

(54) FUNCTIONALTIES OF AXIALLY MOVABLE SPOOL VALVE

(75) Inventors: Hans Christian Petersen, Nordborg (DK); Tom Tychsen, Graasten (DK)

(73) Assignee: Sauer-Danfoss ApS (DK)

( * ) Notice: Subject to any disclaimer, the term of this patent is extended or adjusted under 35 U.S.C. 154(b) by 0 days.

(21) Appl. No.: 10/266,521

(22) Filed: Oct. 8, 2002

(65) Prior Publication Data

US 2004/0067148 A1 Apr. 8, 2004

(51) Int. Cl.[7] ..... F01C 1/02
(52) U.S. Cl. ..... 418/61.3; 137/565.28
(58) Field of Search ..... 418/61.3; 137/565.28; 251/63.5

(56) References Cited

U.S. PATENT DOCUMENTS

RE25,291 E * 12/1962 Charlson ..... 418/61.3
3,598,509 A * 8/1971 Goff et al. ..... 418/61.3
3,606,598 A * 9/1971 Albers ..... 418/61.3
3,698,841 A * 10/1972 Lusziig ..... 418/61.3

* cited by examiner

*Primary Examiner*—Thomas Denion
*Assistant Examiner*—Theresa Trieu

(57) ABSTRACT

A valve member includes an axially movable spool valve rotatably mounted in the valve member to cause the way that fluid is communicated between the inlet and outlet ports of the device and the volume chambers thereof. An outer surface of the spool has a configuration to react to fluid pressure to effect the timing between the gear set and the valving of valve member and that the timing therebetween will be adjusted when the spool valve is moved axially. A valve actuator comprising a spring loaded plunger controlled by fluid pressure at the inlet and outlet ports is in physical contact with one end of the valve spool.

2 Claims, 3 Drawing Sheets

FUNCTIONALTIES OF AXIALLY MOVABLE SPOOL VALVE

BACKGROUND OF THE INVENTION

Spool valving "lags" take place in the volume chambers of a gerotor gear set. By way of example only, as one of the volume chambers becomes a maximum volume transition chamber, the spool valving will continue for one or two more degrees of rotation to communicate high pressure fluid into that volume chamber, the volume of which is not changing. The instantaneous result will be that the volume chamber has begun to shrink while still communicating with high pressure. Then the valving shuts off and the chamber shrinks further, and because of overlap in the valving, with no way to relieve pressure in the chamber, the fluid pressure will rise rapidly creating a pressure pulse or spike in that volume chamber. Such incorrect timing will result in a number of problems in the gerotor, each of which will have a further detrimental effect on volumetric efficiency and motor smoothness.

Therefore, the principal object of this invention is to provide a spool valve that is axially movable to cause the way that the oil is communicated between the inlet and outlet of the motor and the volume chambers of the motor to deal with a solution to the problems of valve timing through adjustability of the timing.

This and other objects will be apparent to those skilled in the art.

SUMMARY OF THE INVENTION

The motor of this invention has a small valve transmission shaft between gear set and spool valve, and a port plate between gear set and valve housing. The purpose of the port plate is partly to reduce the tilting angle of the valve transmission shaft, and partly to seal between the volume chambers of the gear set and the bore in the valve housing. The latter of the two occurs, because the bore in the port plate is smaller than the bore in the valve housing.

In the valve housing, a spool valve with a shorter length than the length of the bore is arranged. The spool valve is rotated together with the gear set, due to the valve transmission shaft, but is free to move axially. A support rod will keep the valve transmission shaft in position, and a spring acting upon the support rod will force the valve towards the push rod of the valve actuator.

The inlet and outlet ports are in connection with individual ring chambers on the spool valve, independently of the axial position of the valve. Through axial connections in the spool valve, oil is communicated from the ring chambers to oil passages in the valve housing, leading to each of the volume chambers. By rotating the spool valve, together with the gear set, oil is communicated between an inlet and an outlet of the motor and the volume chambers of the motor.

DESCRIPTION OF THE PREFERRED EMBODIMENT

Figure 1:
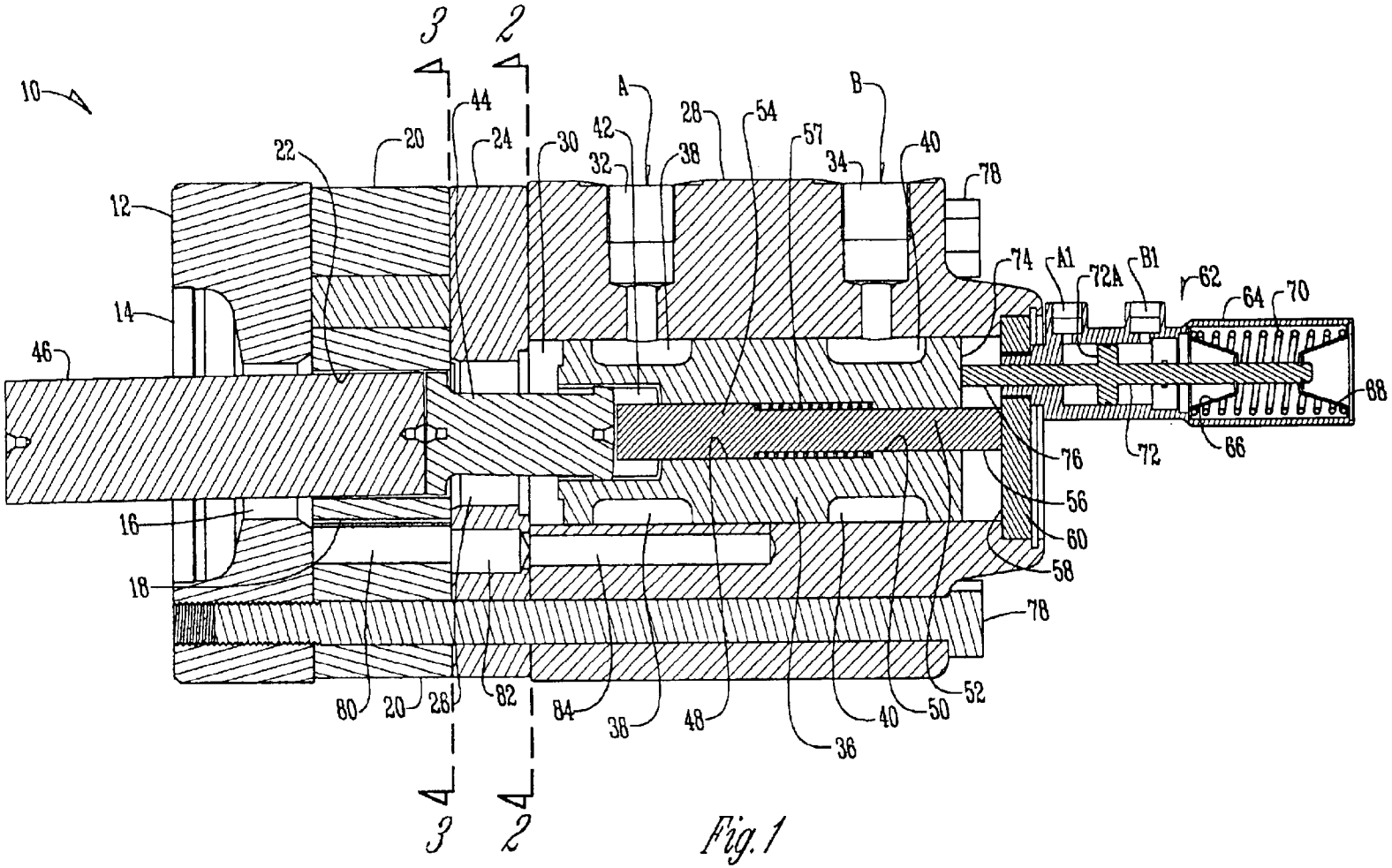
FIG. 1 is a longitudinal sectional view of a motor embodying this invention.

With reference to FIG. 1, a gerotor motor 10 of the spool valve type has an end plate 12 having a well opening 14 which terminates into a center opening 16. A gear set 18 is mounted within gear assembly 20 which has a center opening 22 communicating with the opening 16 in end plate 12.

A port plate 24 is located immediately adjacent the gear set assembly 20 and has a center opening 26.

A valve housing 28 is located immediately adjacent the port plate 24 and has a center bore 30 which registers with the center opening 26 in port plate 24. Valve housing 28 has two ports A and B designated by the numerals 32 and 34, respectively, which extend from the exterior of the housing 28 and communicate with the interior of center bore 30.

A spool valve 36 is slidably longitudinally mounted within bore 30 and has annular ring chambers 38 and 40 which communicate with ports 32 and 34 respectively. An end bore 42 is located on the inner end of spool valve 36.

A valve transmission shaft 44 has its outer end connected to the inner end of dog bone shaft 46 which is spline connected to gear set 18 at the inner end of shaft 46. The valve transmission shaft 44 extends through the center opening 26 of port plate 24. The inner end of valve transmission shaft 44 is slidably mounted within the end bore 42 of spool valve 36.

Spool valve 36 has a bore segment 48 communicating with end bore 42. Bore segment 48 terminates in bore segment 50 of a smaller diameter. The numeral 52 designates a piston support for shaft 44 which is slidably mounted within bore segments 48 and 50 and has an inner end that penetrates into the end bore 42. A piston support head 54 terminates into an elongated stem 56 with the head 54 being slidably mounted within bore segment 48 and with stem 56 being slidably mounted within bore segment 50. A compression spring 57 is located in bore segment 48 and has an inner end bearing against piston support head 54, with the other end bearing against the outer end of bore segment 48. As previously indicated, the stem 565 is slidably mounted around the bore segment 50 and protrudes outwardly from the end of spool valve 36 to engage the inner surface 58 of end cover 60.

A valve actuator 62 is mounted on the end cover 60 and has a valve actuator housing 64. Opposite flexible cups 66 and 68 are mounted within the outer end of housing 64 and are connected to the outer end of plunger 72. Spring 70 surrounds the cup 66 and 68 and causes the plunger 72 to normally be in the neutral position shown in FIG. 1 wherein neither of the cups 66 or 68 are in a state of compression or extension. The inner end of plunger 72 engages the outer end 74 of spool valve 36. The numeral 76 designates the inner end of plunger 72.

Plunger 72 has a center portion 72A which has its opposite surfaces connected to ports A and B (32 and 34 respectively) via ports A1 and B1 in valve housing 64.

A plurality of elongated bolts 78 pass through registering holes in members 12, 20, 24 and 28 and are threadably secured by threaded apertures in end plate 12.

Fluid passages 80, 82 and 84 are in registering relation in members 20, 24 and 28.

Figure 2:
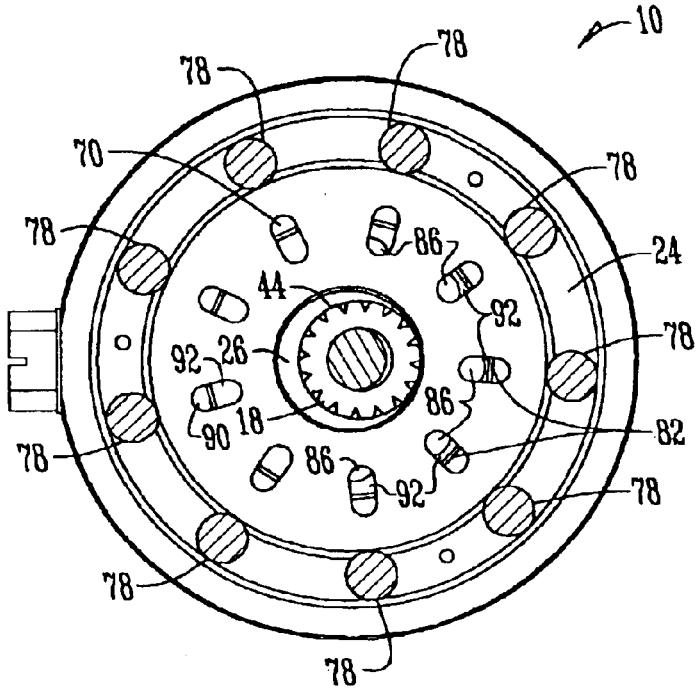
FIG. 2 is a sectional view taken on line 2—2 of FIG. 1.

FIG. 2 is a sectional view taken on line 2—2 of FIG. 1 and shows the port plate 24, the center opening 26 therein and the shaft 44.

Figure 3:
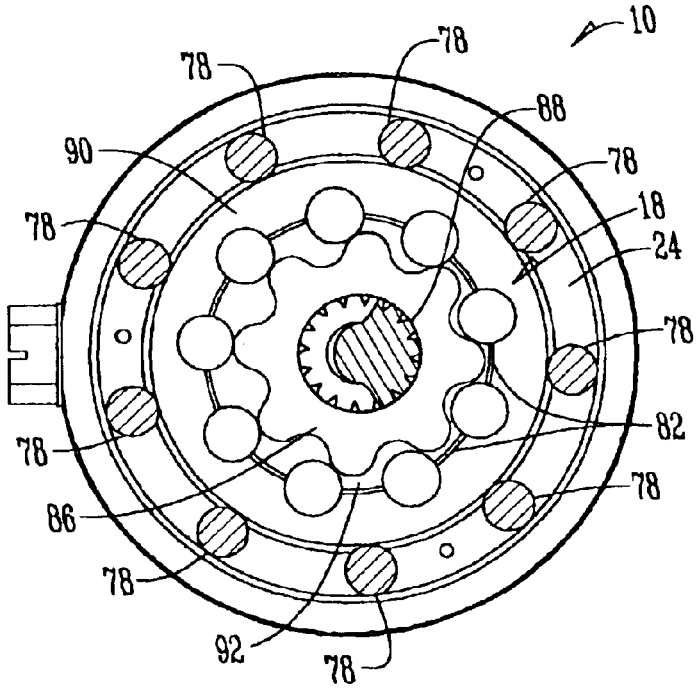
FIG. 3 is a sectional view taken on line 3—3 of FIG. 1.

FIG. 3 is a sectional view taken on line 3—3 of FIG. 1 and shows the gear set 18 with star member 86 having a center aperture 88; a ring member 90 and conventional rollers. The numeral 92 designates a valve chamber characteristic of gerotor motors.

The motor of this invention has a small valve transmission shaft between gear set and spool valve, and a port plate between gear set and valve housing. The purpose of the port plate is partly to reduce the tilting angle of the valve transmission shaft, and partly to seal between the volume chambers of the gear set and the bore in the valve housing. The latter of the two occurs, because the bore in the port plate is smaller than the bore in the valve housing.

In the valve housing, a spool valve with a shorter length than the length of the bore is arranged. The spool valve is rotated together with the gear set, due to the valve transmission shaft, but is free to move axially. A support rod will keep the valve transmission shaft in position, and a spring acting upon the support rod will force the valve towards the push rod of the valve actuator.

The inlet and outlet ports are in connection with individual ring chambers on the spool valve, independently of the axial position of the valve. Through axial connections in the spool valve, oil is communicated from the ring chambers to oil passages in the valve housing, leading to each of the volume chambers. By rotating the spool valve, together with the gear set, oil is communicated between inlet and outlet of the motor and the volume chambers of the motor.

Figure 4:
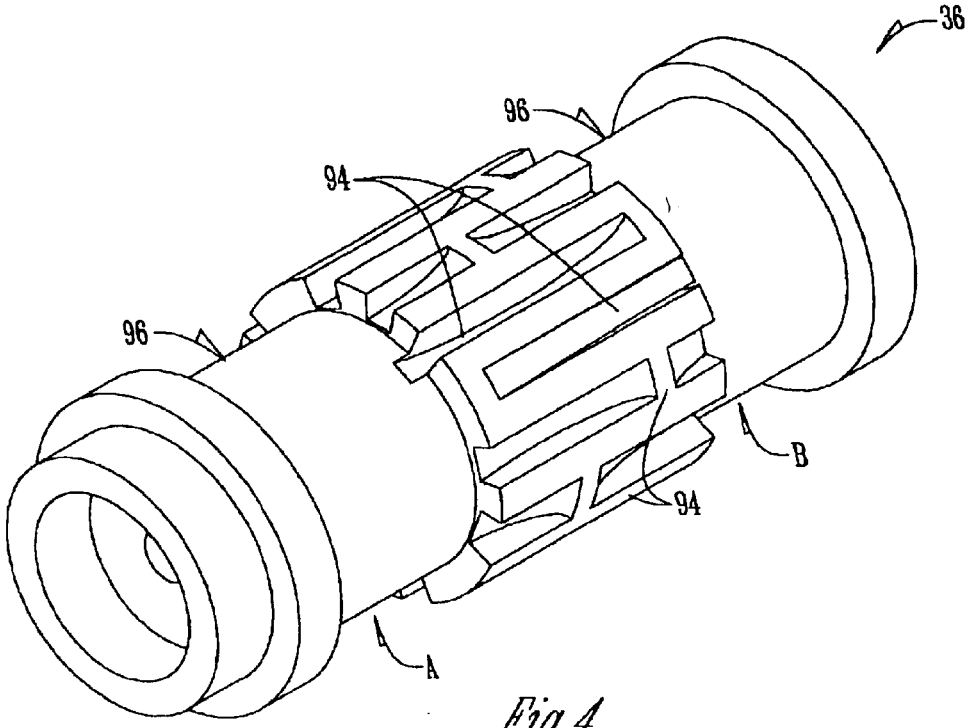
FIG. 4 is a perspective view of a spool valve of this invention.

In FIG. 4 a spool valve 36 is shown, which has pure axial connections. Some of them (94) are "fixed" and are running from one ring chamber 96 and close to the other. Others are running from each ring chamber and close to each other. In one axial position, where the oil passages in the valve housing fits with the center of the spool valve, a given oil passage in the valve housing will connect alternately to A and B ports of the motor. Moving the spool valve 24 axially will change this alternation, and a given oil passage will then connect to the A port three times and then to the B port, or to the B port three times and then to the A port. This gives the same result as that of U.S. Pat. No. 6,033,195, but without a separate valve and with only one connection between valve and each volume chamber.

With the spool valve 24 of FIG. 4 placed in the motor of FIG. 1, controlling the valve actuator 62 will control the displacement of the motor. The actuator 62 shown in FIG. 1 will in a no-load position move at the center position. Adding a control fluid to port A will force the actuator to the right, and the left cup-shaped element 66 will follow the valve actuator 62. The spring 70 is thereby tensioned, and when the control fluid is relived from port A, the actuator is moved to the center position by the spring 70.

Figure 5:
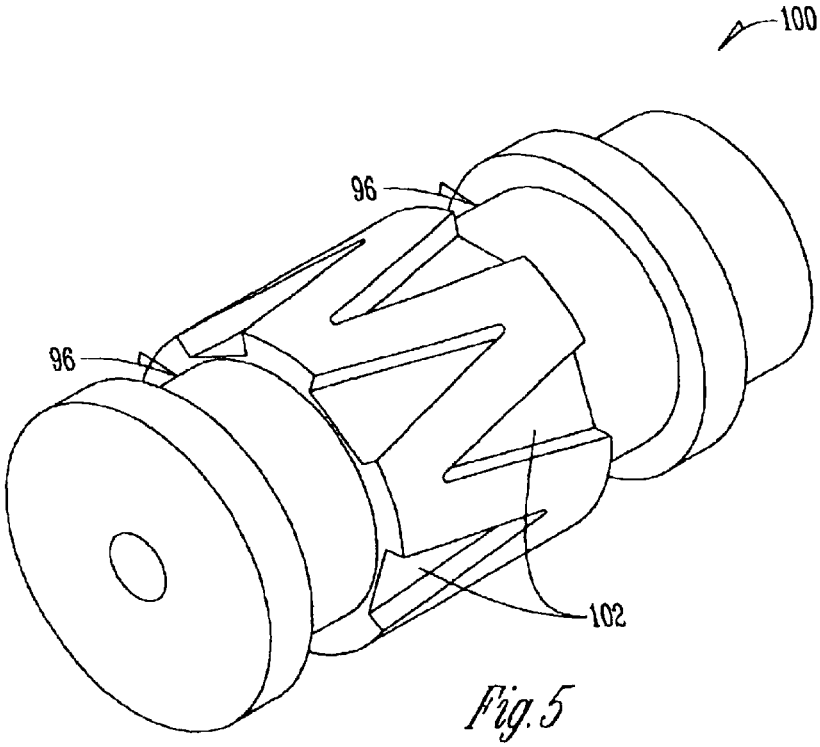
FIG. 5 is a perspective view of an alternate form of a spool valve of this invention.

An alternate spool valve geometry is shown by the valve 100 in FIG. 5, where the axial connections 102 are cone-shaped. This will have the effect that the timing between gear set 18 and valving will be adjusted when the spool valve 100 is moved axially. The problems described in U.S. Pat. No. 6,126,424 can thus be avoided, as the timing is adjustable. The function only depends on the geometry of the spool valve, in the axial direction. Once again, the invention is the moveable spool valve.

What is claimed is:

1. A rotary fluid pressure device of the type including a housing having a fluid inlet port and a fluid outlet port; the housing having an internally-toothed ring member, and an externally-toothed star member eccentrically disposed within said ring member for relative orbital and rotational movement therebetween to define a plurality of expanding and contracting fluid volume chambers in response to said orbital and rotational movements, and minimum and maximum volume transition chambers; a valve member cooperating with said housing to provide fluid communication between said inlet port and said expanding volume chambers and between said contracting volume chambers and said outlet port; an output shaft and drive shaft for transmitting said rotational movement from said star member to said output shaft; said valve member and said housing cooperating to define a nominal valve overlap; said device being characterized by:

the valve member having an axially movable spool valve rotatably mounted in the said housing to cause the way that fluid is communicated between the inlet and outlet ports of the device and the volume chambers thereof wherein a valve actuator comprising a spring loaded plunger controlled by fluid pressure at the inlet and outlet ports is in physical contact with one end of the spool valve.

2. A rotary fluid pressure device of the type including a housing having a fluid inlet port and a fluid outlet port; the housing having an internally-toothed ring member, and an externally-toothed star member eccentrically disposed within said ring member for relative orbital and rotational movement therebetween to define a plurality of expanding and contracting fluid volume chambers in response to said orbital and rotational movements, and minimum and maximum volume transition chambers; a valve member cooperating with said housing to provide fluid communication between said inlet port and said expanding volume chambers and between said contracting volume chambers and said outlet port; an output shaft and drive shaft for transmitting said rotational movement from said star member to said output shaft; said valve member and said housing cooperating to define a nominal valve overlap; said device being characterized by:

the valve member having an axially movable spool valve rotatably mounted in the said housing to cause the way that fluid is communicated between the inlet and outlet ports of the device and the volume chambers thereof; and a valve actuator comprising a spring loaded plunger controlled by fluid pressure at the inlet and outlet ports is in physical contact with one end of the spool valve.

* * * * *